United States Patent [19]

Kellogg et al.

[11] Patent Number: 4,788,131

[45] Date of Patent: Nov. 29, 1988

[54] METHOD OF ELECTRONIC PROCESSING OF EXPOSED PHOTOGRAPHIC MATERIAL

[75] Inventors: Lillian M. Kellogg, Webster; Joseph M. Hodes, Rochester, both of N.Y.

[73] Assignee: Eastman Kodak Company, Rochester, N.Y.

[21] Appl. No.: 79,612

[22] Filed: Jul. 30, 1987

[51] Int. Cl.[4] ..... G03C 5/00

[52] U.S. Cl. ..... 430/394; 430/21; 430/48; 430/97

[58] Field of Search ..... 430/21, 48, 394, 97

[56] References Cited

PUBLICATIONS

Journal of Imaging Science, vol 30, No. 1, pp. 13–15.

Photographic Science & Engineering, vol. 16, No. 2, Mar./Apr. (1972), pp. 115–119.

Journal of the Soc. of Photo. Sci. & Tech. of Japan, vol. 49, No. 5, Oct. 1986, pp. 388–392.

Photographic Science & Engineering, vol. 24, No. 5, Sep./Oct. (1980), pp. 219–226.

*Primary Examiner*—Paul R. Michl

*Assistant Examiner*—Patrick A. Doody

*Attorney, Agent, or Firm*—Thomas F. Kirchoff

[57] ABSTRACT

A method is described for electronically processing exposed photographic materials for detection and measurement of latent images contained therein.

12 Claims, 3 Drawing Sheets

METHOD OF ELECTRONIC PROCESSING OF EXPOSED PHOTOGRAPHIC MATERIAL

The present invention relates to electronic processing of exposed photographic material. In particular, this invention relates to the use of selected electromagnetic radiation for detection of a latent image in exposed photographic material using an excitation induced photoconductivity technique.

The latent image in silver halide crystals is formed through the excitation of free charge carriers by absorbed photons and their subsequent trapping within the silver halide grain structure to form latent image centers. The use of electromagnetic radiation to detect latent image formation in exposed silver halide grains has been recognized in the photographic art. For example, the January/February 1986 issue of *Journal of Imaging Science,* Vol. 30, No. 1, pp 13–15, in an article entitled "Detection of Latent Image by Microwave Photoconductivity", describes experiments designed to detect latent image formation in silver halide using microwave photoconductivity. The technique, which is operated at room temperature, is recognized as potentially useful in detection of latent images without the need for conventional chemical development solution processing.

Carriers which are thought to play an important role in the formation of latent image centers in silver halide grains are believed to be electrons, holes and interstitial silver ions. The mobility of electrons is far greater than that of holes or interstitial silver ions so that conductivity attributed to photoelectrons is expected to be detectable by measurement of photoconductivity of silver halide grains through use of microwave radiation. Such a measurement has been reported using low temperatures, L. M. Kellogg et al. Photogr. Sci. Eng. 16, 115 (1972).

However, the use of microwave frequencies to detect latent image in exposed silver halide photographic materials has shown that such photoconductivity is not sufficiently sensitive to detect low exposure levels.

Accordingly, there is a need to improve the sensitivity level of electronic processing techniques for detection and measurement of latent images in silver halide photographic materials.

The present invention provides a method of electronic processing of a latent image from a photographic element comprising the steps of:

(a) providing an exposed photographic element;
(b) placing the element in an electromagnetic field and cooling the element to prevent further image formation;
(c) subjecting the element to a uniform exposure of relatively short wavelength radiation;
(d) exposing the element to pulsed, high intensity, relatively longer wavelength radiation to excite electrons out of image centers; and
(e) measuring any resulting signal with radiofrequency photoconductivity apparatus.

The method of this invention lends itself to application with systems based on reactions wherein an image is formed as the result of photochemical activity. This method is particularly effective with photographic materials having high density areas or areas of overexposure due to its enhanced sensitivity of measurement.

Following measurement of any signal using radiofrequency photoconductivity apparatus, an optional further processing step of recording or converting the signal to a visible display corresponding to the latent image pattern in the element can be employed.

Determination of the presence or absence of a latent image by use of radiation energy to generate free electrons can be carried out in a photoconductivity measurement capacitor where a sample of exposed photographic material is placed and subjected to a uniform exposure of radiation. This step functions to generate free electrons in the sample to fill electron traps associated with the latent image centers. When a reflection type cavity resonator is used a signal reflected by the cavity resonator changes with the conductivity of the inserted sample.

Use of radiofrequency photoconductivity apparatus for detection of the presence or absence of a latent image following a pulsed, high intensity, relatively longer wavelength radiation exposure of the photographic material provides enhanced sensitivity measurement utilizing lower frequency fields of high intensity radiation in comparison with microwave photoconductivity measurements mentioned in the prior art. Useful radiofrequency fields between about $10^3$ to about $10^9$ cycles/second, or as measured in wavelength, from about $10^{-1}$ to about $10^5$ meters, are capable of detecting small numbers of electrons excited from the latent image centers. This provides enhanced sensitivity measurement utilizing lower frequency fields of high intensity.

The type of silver halides to which the process of this invention can be applied include silver chloride, silver bromide, silver bromoiodide, silver chlorobromide, silver chloroiodide, silver chlorobromoiodide and mixtures thereof. The silver halide crystals can be coarse, medium or fine grains or mixtures thereof. The grains may be of different morphologies, e.g., spherical, cubic, cubooctrahedral, tabular, etc., or mixtures thereto. Grain size distribution may be monodisperse or polydisperse or mixtures thereof.

Measurement of photoconductivity in an exposed photographic element is accomplished at reduced temperatures. Cooling of the exposed element serves to preserve the latent image present in the material as a result of exposure. Cooling also serves to maintain the position of electrons contained in latent image centers or traps. Cooling to a temperature between about 4 to about 270K, preferably to about 40 to about 180K yields not only acceptable but also reproduceable results.

It has been found that the method of this invention can be performed under conditions requiring less cooling, while providing adequate preservation of the latent image, when the photographic element comprises silver halide if a silver ion complexing agent is present in the element. For example, when such a complexing agent is present in reactive association with silver halide grains, the process described herein can be operated between about 20 and 100K with satisfactory results.

Silver halide complexing agents which can be used in this invention include nitrogen acids such as benzotriazole, and the alkyl, halo and nitro substituents thereof; tetraazaindene compounds as described, for example, in U.S. Pat. Nos. 2,444,605; 2,933,388; 3,202,512; UK Pat. No. 1,338,567 and *Research Disclosure,* Vol. 134, June 1975, Item 13452 and Vol. 148, August 1976, Item 14851; and mercaptotetrazole compounds as described, for example, in U.S. Pat. Nos. 2,403,927; 3,266,897; 3,397,987; 3,708,303 and *Research Disclosure,* Vol. 116, December 1973, Item 11684.

The amount of silver halide complexing agent which can be used can vary from about 0.03 to about 3 g per mole of silver, with a preferred range of from about 0.15 to about 1.75 g/Ag mole.

The step of subjecting the photographic element to a uniform radiation exposure of short wavelength has the effect of filling electron traps formed during the original imagewise exposure.

The filled electron traps are then emptied using pulsed, high intensity, relatively longer wavelength radiation, which is outside the range of the original image-forming radiation wavelength region to excite electrons out of image centers. This longer wavelength radiation is focused to a narrow beam in order to detect electron traps on an imagewise basis. When the initial image-forming radiation wavelength is in the blue-green regions, the longer wavelength region, for example, can be in the red or the infrared region of the spectrum.

The optional step of recording or converting the detected signal as a pulsed radio frequency photoconductivity response is useful for storage and subsequent display. Alternatively, the detected signal can be visibly displayed by use of known techniques, for example, utilizing a digitizer with a cathode ray tube and a computer. The magnitude of the detected signal is proportional to the original imaging exposure of the photographic element. It will be appreciated that the detected signal can be processed by techniques known in the art to enhance the recorded or displayed image.

The following examples and drawings will serve to illustrate the invention. In the drawings.

EXAMPLE 1

A 0.9 μm octahedral silver bromide emulsion was coated with 4-hydroxy-6-methyl-1,3,3a,7-tetraazaindene (1 g/mole Ag) at 4.3 g Ag/m$^2$ and 8.6 g gel/m$^2$ upon a film support.

Figure 1:
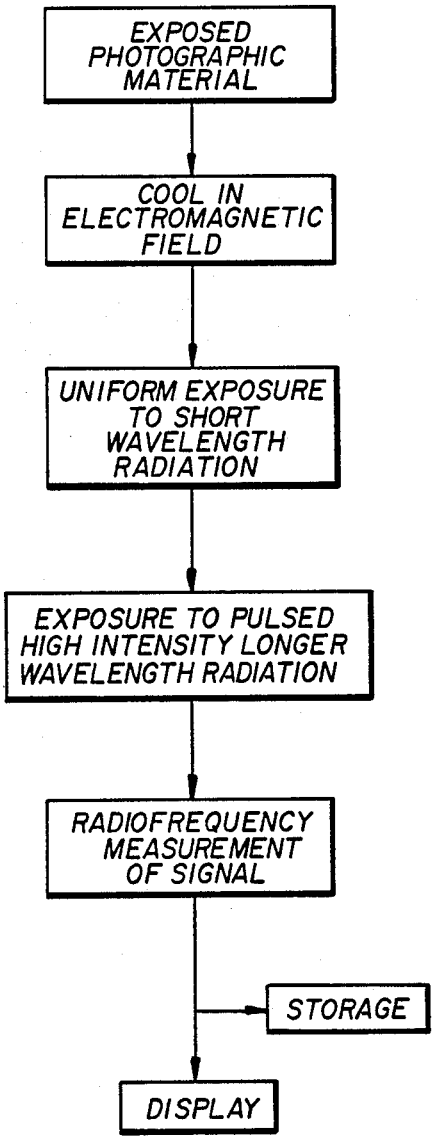
FIG. 1 is a flow diagram showing the individual steps in the electronic process of this invention.
Figure 2:
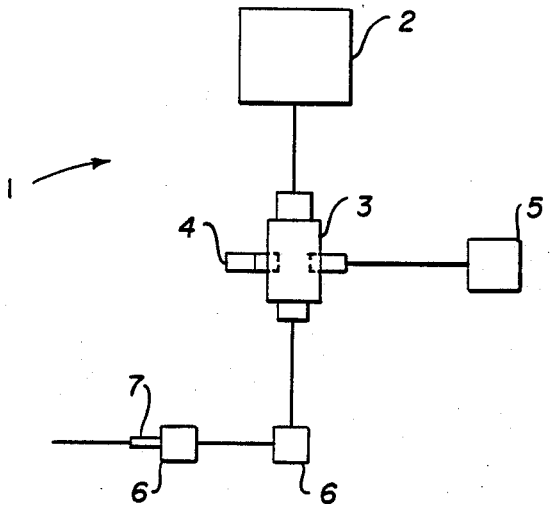
FIG. 2 represents a schematic drawing of a radiofrequency photoconductivity measurement apparatus for use in the electronic process of this invention.

Six samples of the emulsion coating were cut to fit a sample capacitor in a radiofrequency (RF) photoconductivity measurement apparatus according to FIG. 2.

FIG. 2 illustrates a photoconductive measurement apparatus 1 comprising a radiofrequency oscillator 2 and a radiofrequency bridge 3. In association with bridge 3 is a 50 ohm terminator 4 and a tuned LC circuit 5. Preamplification means 6 are provided as is detector 7.

Figure 3:
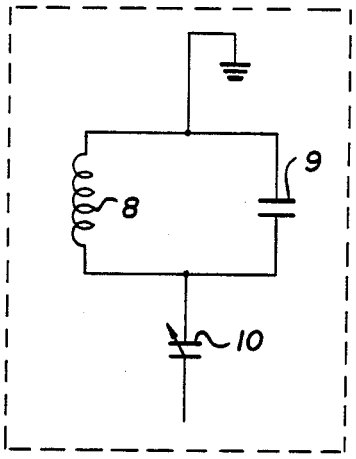
FIG. 3 is a detailed view of the tuned LC circuit of FIG. 2.

FIG. 3 illustrates, in greater detail, the tuned LC circuit 5 of FIG. 2 wherein is shown inductor 8 along with sample capacitor 9 and variable capacitor 10.

Each sample was exposed at room temperature to a $10^{-2}$ sec EG&G sensitometer exposure with a different neutral density (ND) filter in the exposure beam (ND-2.0 to 3.6). One sample at a time was then placed in the sample capacitor, cooled with liquid nitrogen boil-off gas to about 97K, exposed to blue radiation and pulsed with red radiation. Resulting signals were measured and recorded on a visual display. For this series of measurements the wavelength of the red radiation was 660 nm, the total energy per pulse was 38 microjoules and the beam was focused to an area of 1 mm$^2$.

For comparison, another strip of the same emulsion coating was exposed ($10^{-2}$ sec EG&G, 2.0 ND) through a graduated density step wedge and processed (6 min, 20° C.) in an Elon-hydroquinone developer.

Table 1 below records the exposure, the induced photoconductivity signal observed, and the corresponding developed density of the comparison coating:

TABLE I

| $10^{-2}$ Sec EG & G Exposure | Induced Signal (mv) | Comparative Developed Density |
|---|---|---|
| +2.0 ND | 22 | 2.2 |
| +2.3 ND | 18.6 | 2.1 |
| +2.6 ND | 15.2 | 1.8 |
| +3.0 ND | 11.2 | 1.6 |
| +3.3 ND | 7.2 | 1.3 |
| +3.6 ND | 4.8 | 0.88 |

Figure 4:
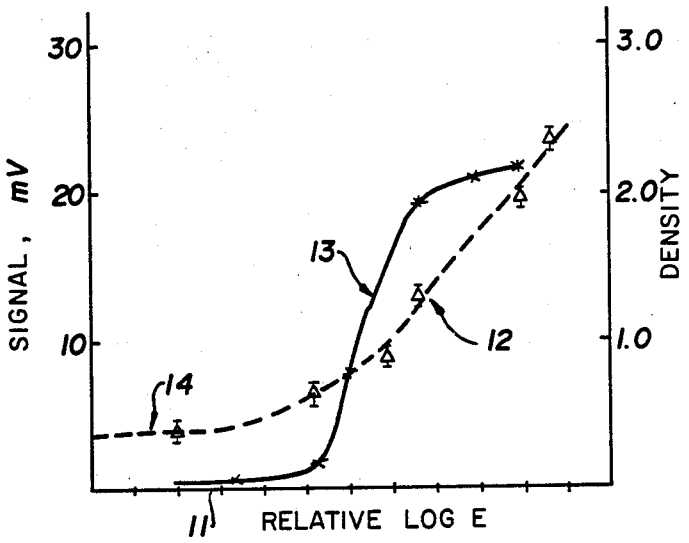
FIG. 4 illustrates a silver density curve obtained by chemical processing and an optical density curve obtained by electronic processing of identically exposed photographic samples.

FIG. 4 reflects the plots 11 of the data from Table I as an H and D curve 13, for the chemically developed comparative strip, and as a signal in millivolts vs exposure 12 for the electronically processed strip. Background "noise" is indicated as 14 on curve 12.

EXAMPLE 2

The radio frequency photoconductivity apparatus was modified to use liquid helium cooling and narrower capacitor electrodes. A time delay circuit was also constructed so the blue background exposure was provided by a strobe flash and the red pulse was delayed to allow for decay of free carriers resulting from the blue exposure. With this arrangement the laser beam was focused to 0.1 sq mm.

A sulfur sensitized 0.9 μm octahedral silver bromide emulsion was coated with 4-hydroxy-6-methyl-1,3,3a,7-tetraazaindene (1 g/mole Ag) at 4.3 g Ag/m$^2$ and 8.6 g gel/m$^2$ upon a film support. Seven samples of this emulsion coating were cut to fit the sample capacitor in the RF apparatus. One sample was not exposed. This sample was used to determine the background signal. Each of the other six samples was exposed to a $10^{-2}$ sec EG&G with a different neutral density (ND) in the exposure beam (ND=2.0 to 4.0). One sample at a time was then placed in the sample capacitor, cooled to about 65K, flashed with a blue flash, and then pulsed with red radiation. For this series of measurements the wavelength of the red radiation was 660 nm and the total energy per pulse was 38 microjoules.

For comparison, seven strips of the same emulsion were cut and exposed the same way, but each individual strip was processed for 3 min. 20° C. in an Elon-hydroquinone developer.

Table II records the exposure, the induced photoconductivity signal observed, and the corresponding developed density of the comparison coating.

TABLE II

| $10^{-2}$ Sec EG & G Exposure | Induced Signal (mv) | Developed Density |
|---|---|---|
| +3.44 ND | 6.5 ± 0.8 | 0.15 ± 0.02 |
| +3.21 ND | 7.6 ± 0.8 | 0.80 ± 0.05 |
| +2.95 ND | 9.0 ± 0.8 | 1.52 ± 0.08 |
| +2.73 ND | 13.0 ± 0.8 | 1.98 ± 0.08 |
| +2.05 ND | 19.5 ± 0.8 | 2.16 ± 0.08 |
| +1.83 ND | 23.5 ± 0.8 | 2.20 ± 0.08 |

TABLE II-continued

| $10^{-2}$ Sec EG & G Exposure | Induced Signal (mv) | Developed Density |
|---|---|---|
| NONE | 4.0 ± 0.5 (background fog) | 0.05 ± 0.01 (fog) |

The ± values are the 95% confidence limits as determined from several measurements at each exposure level.

EXAMPLE 3

For high exposure levels additional latent image centers are formed in the emulsion and although a maximum exposure level for chemical processing is observed, this is not the maximum exposure level for electronic processing. Table III records the exposure, the induced photoconductivity signal observed, and the developed density for a "Dmax" exposure and two exposure levels well beyond the "Dmax" for chemical development.

TABLE III

| $10^{-2}$ Sec EG & G Exposure | Induced Signal (mv) | Developed Density |
|---|---|---|
| +1.83 ND | 23.5 ± 0.8 | 2.20 ± 0.08 |
| +0.95 ND | 47 ± 2 | 2.2 |
| +0.00 ND | 69 ± 2 | 2.2 |

These results show that more information can be recovered from strips that are electronically processed than strips that are chemically developed.

EXAMPLE 4

To demonstrate the ability of the process of this invention to detect signals imagewise, two mirrors, one fixed and one movable, were placed in the laser beam to allow a detection beam to be scanned horizontally across an exposed photographic sample. A focusing lens was placed on a translation stage so that the beam was recentered in the lens after each 1 mm shift.

Image letters were cut out of a template and the template and a 1.0 neutral density were placed in the exposure window of the EG&G Sensitometer. Since the measurement capacitor in the apparatus used was very narrow, 5 separate strips were exposed at room temperature to record the entire area of the image letters. The sample was a 0.9 μm AgBr octahedral emulsion as described above in Example 2.

Each strip was cooled to 80K and 14 separate measurements at 1 mm intervals were made on each one of the five strips. The signal magnitude and the beam position were recorded for each of these measurements. Using a plotter and a personal computer a visual image was constructed from this data using the following guidelines:

1. The signal ratio (SR)=SIGNAL/MAXIMUM SIGNAL.
2. If SR>0.9 a box 0.1 inche square was drawn.
3. If SR>0.85 and SR<0.9 a box 0.08 inche square was drawn.
4. If SR>0.75 and SR<0.85 a box 0.06 inche square was drawn.
5. If SR>0.65 and SR<0.75 a box 0.04 inche square was drawn.
6. If SR>0.5 and SR<0.65 a box 0.03 inche square was drawn.

Using these guidelines it was possible to construct an image on a screen associated with the scanning apparatus. These results show that this technique can detect latent image in an imagewise manner.

Electronic processing of a latent image in a color photographic material can be accomplished with the method of this invention using a material having coated, on a transparent poly(ethyleneterephthalate) support, the following layers in the order recited. Coverages of each component are listed parenthetically in g/m$^2$ and all parts, percentages and ratios are by weight unless otherwise specified.

1. A silver bromide (4.3) emulsion layer, as described in Example 1, sensitized to blue light.
2. A yellow layer comprising gelatin (8.6) and a filter dye (0.15) to prevent blue light from passing into the remaining layers of the material.
3. A silver bromide emulsion layer, as described in layer 1, sensitized to green light.
4. A silver bromide emulsion layer as described in layer 1 sensitized to red light. The red sensitizing dye absorbs in the wavelength region of about 600–605 nm.

When the described color photographic element has been exposed and cooled, as described in Example 1, the latent image is capable of being processed in the following manner: The blue sensitive layer can be flashed with uniform blue light to fill the latent image centers in the emulsion with electrons. This layer can then be processed as described in Example 1. The latent image centers in the green sensitive layer can then be flashed with green light and processed as described for the blue sensitive layer. The photographic element can then be subjected to pulsed, high intensity, red light having a longer wavelength of about 640–645 nm. Any resulting signal can then be measured with radiofrequency photoconductivity apparatus.

The method described above is equally applicable for detection of latent image centers resulting from light exposure of black and white photographic recording materials, including X-ray films, of inorganic phosphors, of photoconductors used in electrophotography, to single and multicolor recording materials, including materials having incorporated or non-incorporated couplers, to various inorganic semiconductor materials as well as to variations and modifications of the electronic apparatus described in this invention.

What is claimed is:

1. A method of electronic processing of a latent image from a photographic element comprising the steps of:

(a) providing an exposed photographic element comprising photosensitive silver halide grains;

(b) placing the element in an electromagnetic field and cooling the element to a temperature between about 4 to about 270K to prevent further image formation;

(c) subjecting the element to a uniform exposure of relatively short wavelength radiation;

(d) exposing the element to pulsed, high intensity, relatively longer wavelength radiation to excite electrons out of image centers; and (e) measuring any resulting signal with radiofrequency photoconductivity apparatus.

2. The method of claim 1 which includes the further step of recording or converting the signal to a visible display corresponding to the latent image pattern in the element.

3. The method of claim 1 wherein the wavelength of the radiofrequency field is between about $10^3$ to about $10^9$ cycles/second.

4. The method of claim 1 wherein the grains are tabular silver halide grains.

5. The method of claim 1 wherein cooling is to a temperature between about 40 to about 180K.

6. The method of claim 5 wherein the element comprises a silver halide complexing agent.

7. The method of claim 6 wherein the complexing agent is a benzotriazole, a tetraazaindene or a phenylmercaptotetrazole compound.

8. The method of claim 6 wherein the complexing agent is a tetraazaindene compound.

9. The method of claim 6 wherein the complexing agent is present in an amount of from about 0.03 to about 3 g for each mole of silver present in the element.

10. The method of claim 9 wherein the silver complexing agent is present in an amount of from about 0.15 to about 1.75 g/Ag mole.

11. The method of claim 6 wherein cooling is a temperature between about 20 to about 100K.

12. The method of claim 1 wherein the relatively short wavelength radiation of step (c) is in the blue-green region of the spectrum and the relatively longer wavelength radiation of step (d) is in the red or infrared region of the spectrum.

* * * * *